US008049428B2

(12) United States Patent
Yang

(10) Patent No.: US 8,049,428 B2
(45) Date of Patent: Nov. 1, 2011

(54) UNI-DIRECTIONAL LIGHT EMITTING DIODE DRIVE CIRCUIT IN PULSED POWER SERIES RESONANCE

(76) Inventor: Tai-Her Yang, Dzan-Hwa (TW)

( * ) Notice: Subject to any disclaimer, the term of this patent is extended or adjusted under 35 U.S.C. 154(b) by 366 days.

(21) Appl. No.: 12/351,909

(22) Filed: Jan. 12, 2009

(65) Prior Publication Data

US 2009/0179576 A1 Jul. 16, 2009

Related U.S. Application Data

(60) Provisional application No. 61/020,802, filed on Jan. 14, 2008.

(51) Int. Cl.
*H05B 37/00* (2006.01)

(52) U.S. Cl. ..... 315/205; 315/307

(58) Field of Classification Search ..... 315/205, 315/307, 287, 207, 244, 248, 258, 283
See application file for complete search history.

(56) References Cited

U.S. PATENT DOCUMENTS

| | | | | |
|---|---|---|---|---|
| 6,380,693 | B1 * | 4/2002 | Kastl | 315/209 R |
| 2007/0109827 | A1 * | 5/2007 | DelaCruz | 363/131 |
| 2008/0018261 | A1 * | 1/2008 | Kastner | 315/192 |

* cited by examiner

*Primary Examiner* — Daniel D Chang
(74) *Attorney, Agent, or Firm* — Rabin & Berdo, P.C.

(57) ABSTRACT

The present invention is disclosed by that the series connected capacitive impedance and inductive impedance are powered by a pulsed power, thereby to produce the bi-directional divided power in series resonance at each impedance, and be rectified by a rectifier device to provide DC power output to drive the unidirectional conducting light emitting diode.

18 Claims, 7 Drawing Sheets

UNI-DIRECTIONAL LIGHT EMITTING DIODE DRIVE CIRCUIT IN PULSED POWER SERIES RESONANCE

BACKGROUND OF THE INVENTION (a) Field of the Present Invention

The present invention is disclosed by that the capacitive impedance components and the inductive impedance component in series connection are powered by a pulsed power, whereof their inherent series resonance frequency produces a series resonance status with the pulse period of the pulsed power, whereof in series resonance, a bi-directional divided power is formed across at the two ends of the capacitive impedance component or of the inductive impedance component and is rectified by a rectifier device to provide DC power output to drive the unidirectional conducting light emitting diode, or to drive the at least two rectifier devices which are respectively parallel connected across the two ends of the first impedance and second impedance while the AC powers of the first impedance and second impedance are respectively through the said rectifier devices to be converted to DC power output, thereby to drive the unidirectional conducting light emitting diodes individually.

If the high frequency bi-directional power is used in the uni-directional light emitting diode drive circuit in pulsed power series resonance, then its volume and weight can be effectively reduced as well as that the cost can be lowered.

(b) Description of the Prior Art

The conventional light emitting diode drive circuit using AC or DC power source is usually series connected with current limit resistors as the impedance to limit the current to the light emitting diode, whereof the voltage drop of the series connected resistive impedance always result in waste of power and accumulation of heat which are the imperfections.

SUMMARY OF THE PRESENT INVENTION

The uni-directional light emitting diode drive circuit in pulsed power series resonance which is disclosed by that the capacitive or inductive impedance components in series connection is provided with a pulsed power input, whereof its inherent series resonance frequency is the same as the pulse period of the pulsed power so it appear in series resonance status, and it is characterized in that the divided power in series resonance across the two ends of the capacitive impedance component or of the inductive impedance component is rectified by a rectifier device to the DC power output, thereby to drive the uni-directional conducting light emitting diode set to emit light.

DESCRIPTION OF MAIN COMPONENT SYMBOLS

Figure 1:
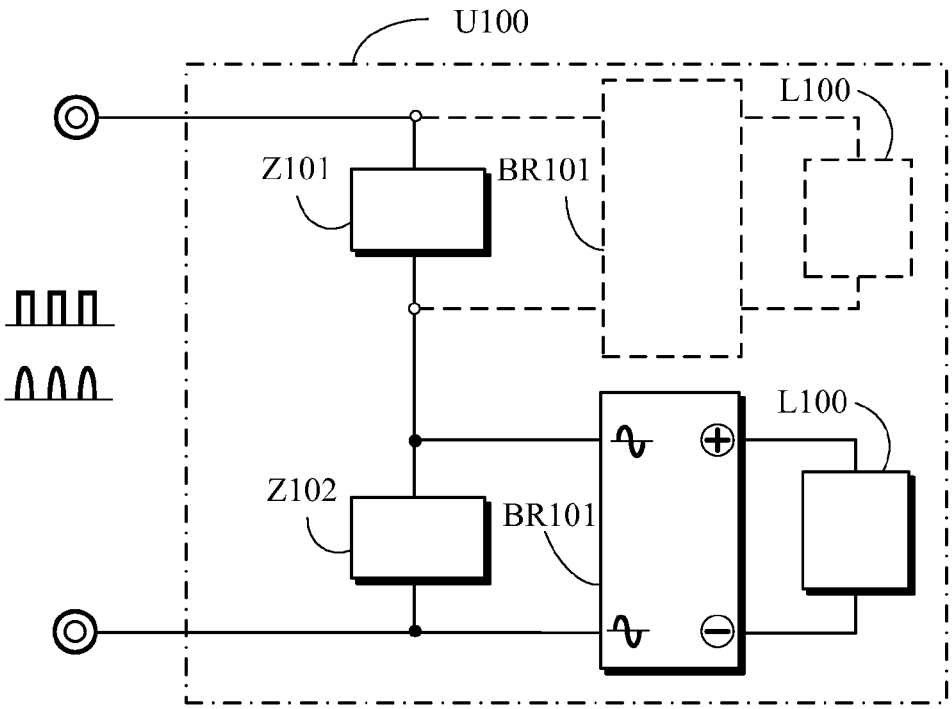
FIG. 1 is the schematic block diagram of the uni-directional light emitting diode drive circuit in pulsed power series resonance.

BR101: Rectifier device
C100: Capacitor
CR201: Diode
ESD101: Charge/discharge device
I103, I200: Inductive impedance component
IT200: Separating type transformer
L100: Uni-directional conducting light emitting diode set
LED101: Light emitting diode
R101: Discharge resistor
R103: Current limit resistor
ST200: Self-coupled transformer
U100: Uni-directional light emitting diode (LED) drive circuit
W0: Self-coupled voltage change winding
W1: Primary side winding
W2: Secondary side winding
Z101: First impedance
Z102: Second impedance
ZD101: Zener diode
300: Bi-directional power modulator of series connection type
360: DC power modulator of series connection type
400: Bi-directional power modulator of parallel connection type

460: DC power modulator of parallel connection type
500: Impedance component
600: Switching device
5000: DC to DC Converter

DETAILED DESCRIPTION OF THE PREFERRED EMBODIMENTS

The uni-directional light emitting diode drive circuit in pulsed power series resonance, in which the circuit function and operation of the uni-directional light emitting diode drive circuit (U100) is mainly comprised of a first impedance which is constituted by at least one capacitive impedance component and a second impedance which is constituted by at least one inductive component, whereof the inherent series resonance frequency of the first impedance and second impedance in series connection is the same as the pulse period of the pulsed power from the power source to appear series resonance status;

The two ends of the first impedance and the second impedance in series connection are provided for inputting:

(1) DC pulsed power; or
(2) The DC pulsed power with constant or variable voltage and constant or variable periods converted from DC power source; or
(3) The DC pulsed power with constant or variable voltage and constant or variable periods converted from DC power which is further rectified from AC power; or
(4) The half-wave or full-wave DC pulsed power rectified from AC power with constant or variable voltage and constant or variable frequency.

In addition, it is installed with at least one rectifier device, whereof its AC input ends are provided to receive the bi-directional divided power input in series connection across the two ends of at least one impedance of the first impedance (Z101) or the second impedance (Z102), or is installed with at least two rectifier devices, whereof their AC input ends are respectively provided to receive the bi-directional divided power input in series resonance across the two ends of the first impedance or of the second impedance;

Further, the uni-directional conducting light emitting diode set which is constituted by at least one light emitting diodes is driven by the DC power output across the positive and negative ends of a rectifier device.

The bi-directional divided power in series resonance of the first and second impedances is rectified by the rectifier device to drive at least one uni-directional conducting light emitting diode or is rectified by the two or more than two rectifier devices which are respectively parallel connected across the two ends of the first and second impedances to provide DC power output to drive the individual uni-directional conducting light emitting diode.

FIG. 1 is the schematic block diagram of the unidirectional light emitting diode drive circuit in pulsed power series resonance, in which the circuit function is operated through the unidirectional light emitting diode drive circuit (U100) as shown in FIG. 1, whereof it is comprised of:

A first impedance (Z101) which is mainly constituted by at least one capacitive impedance component, or two or more than two capacitive impedance components in series connection, or parallel connection, or series and parallel connection, or A first impedance (Z101) is comprised of at least one capacitive impedance component, and it can be optionally installed as needed with one or more than one, and one kind or more than one kind of additional inductive impedance components or resistive impedance components, or optionally installed as needed with two or more than two kinds of impedance components, whereof each kind of impedance components is constituted by one or by more than one impedance component in series connection or parallel connection or series and parallel connection;

A second impedance (Z102) is mainly constituted by an inductive impedance component or two or more than two inductive impedance components in series connection, or parallel connection, or series and parallel connection, or A second impedance (Z102) is comprised of an inductive impedance component, and it can be optionally installed as needed with one or more than one, or one kind or more than one kind of additional capacitive impedance components or resistive impedance components, or optionally installed as needed with two or more than two kinds of impedance components, whereof each kind of impedance components is constituted by one or by more than one impedance component in series connection, or parallel connection, or series and parallel connection;

At least one first impedance (Z101) and at least one second impedance (Z102) are mutually series connected, whereof the two ends of the first impedance (Z101) and the second impedance (Z102) in series connection are provided for inputting:

(1) DC pulsed power; or
(2) The DC pulsed power with constant or variable voltage and constant or variable periods converted from DC power source; or
(3) The DC pulsed power with constant or variable voltage and constant or variable periods converted from DC power which is further rectified from AC power; or
(4) The half-wave or full-wave DC pulsed power rectified from AC power with constant or variable voltage and constant or variable frequency.

The inherent series resonance of the first impedance component (Z101) and second impedance (Z102) in series connection is the same as the pulse period of the pulsed power source so as to appear series resonance status, whereof the divided power in series resonance is converted from the pulsed power input to the first impedance (Z101) and the second impedance (Z102) and provided to the AC input ends of the rectifier device (BR101).

A rectifier device (BR101): It is parallel connected across the two ends of the first impedance (Z101) or of the second impedance (Z102), or respectively parallel connected across two ends of the first impedance (Z101) and of the second impedance (Z102) simultaneously, thereby the bi-directional divided power across the two ends of the first impedance (Z101) or the second impedance (Z102) is rectified to DC power to drive the uni-directional conducting light emitting diode set (L100);

The rectifier device can be constituted by a bridge type rectifier device or by a half-wave rectifier device, whereof the number of rectifier device (BR101) can be one or more than one.

An uni-directional conducting light emitting diode set (L100): The uni-directional conducting light emitting diode set (L100) is constituted by a forward current polarity light emitting diode, or two or more than two forward current polarity light emitting diodes in series connection or parallel connection, or three or more than three forward current polarity light emitting diodes in series connection, or parallel connection, or series and parallel connection.

The uni-directional conducting light emitting diode set (L100) can be optionally disposed with one or more than one set as needed for driven by DC power outputted from the rectifier device (BR101).

One or more than one first impedance (Z101), second impedance (Z102), uni-directional conducting light emitting diode set (L100) and rectifier device (BR101) in the unidirectional light emitting diode drive circuit (U100) can be optionally installed as needed.

The bi-directional divided power produced by the first impedance or second impedance in series resonance is rectified by a rectifier device to DC power and is used to drive at least one unidirectional conducting light emitting diode, or the AC powers of the first impedance and of the second impedance are respectively rectified by the two rectifier devices which are respectively parallel connected across the two ends of the first impedance and second impedance to DC powers and are used to drive the individual uni-directional conducting light emitting diodes, thereby to constitute the uni-directional light emitting diode drive circuit in pulsed power series resonance.

Figure 2:
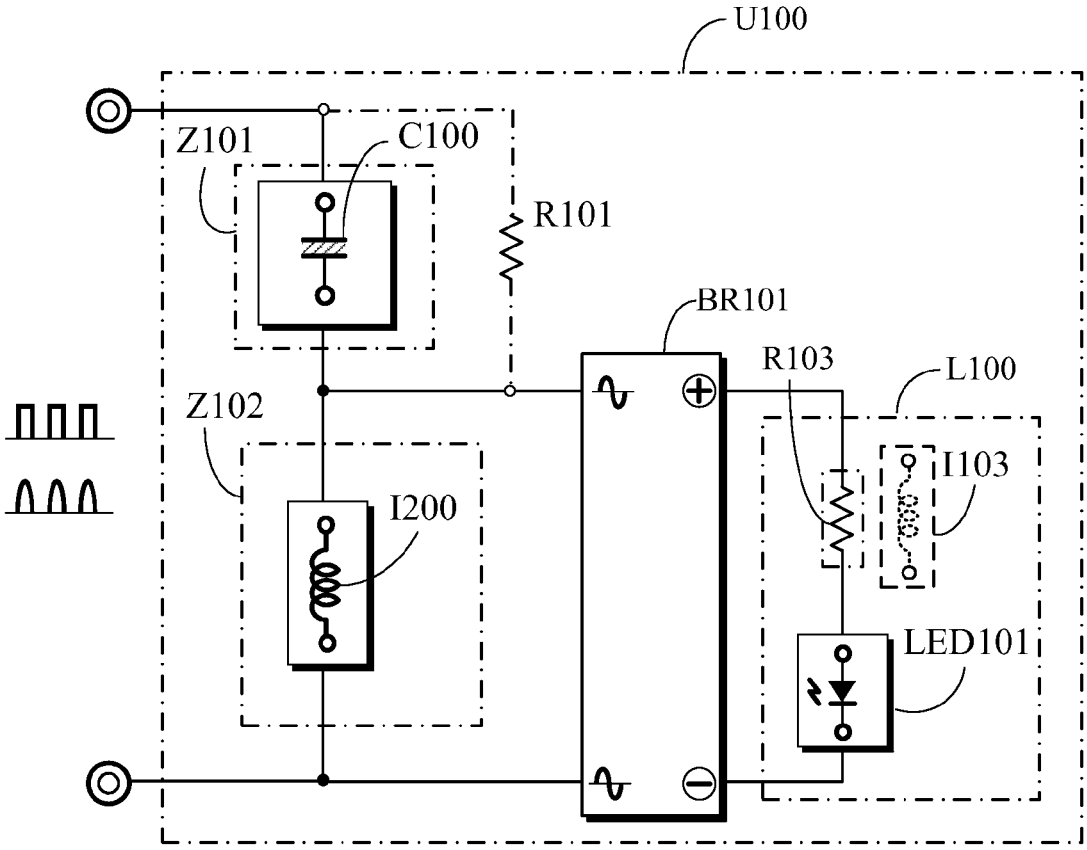
FIG. 2 is the circuit example schematic diagram of the present invention.

For convenience of description, the components listed in the circuit examples of the following exemplary embodiments are selected as in the following:

(1) A first impedance (Z101), a second impedance (Z102), a rectifier device (BR101) and an unidirectional conducting light emitting diode set (L100) are installed in the embodied examples. Nonetheless, the selected quantities are not limited in actual application;

(2) A capacitive impedance component is selected to represent the first impedance (Z101) and an inductive impedance component is selected to represent the second impedance (Z102) in the embodied examples, whereof various capacitive impedance components and inductive impedance components can be optionally selected as needed, or the resistive impedance components can be optionally selected as needed to be series connected, parallel connected, or series and parallel connected in actual applications, whereof the inherent series resonance frequency of the first impedance and the second impedance in series connection is the same as the pulse period of the pulsed power whereby to achieve a series resonance status, wherein it is described in the following:

FIG. 2 is the circuit example schematic diagram of the present invention which is mainly constituted by the following:

A first impedance (Z101): it is constituted by at least one capacitive impedance component, especially by the capacitor (C100), whereof the number of the first impedance can be one or more than one;

A second impedance (Z102): it is constituted by at least one inductive impedance component (I200), whereof the number of the second impedance can be one or more than one;

At least one first impedance (Z101) and the at least one second impedance are in series connection, whereof the two ends of them after series connection are provided for inputting:

(1) DC pulsed power; or (2) The DC pulsed power with constant or variable voltage and constant or variable periods converted from DC power source; or (3) The DC pulsed power with constant or variable voltage and constant or variable periods converted from DC power which is further rectified from AC power; or (4) The half-wave or full-wave DC pulsed power rectified from AC power with constant or variable voltage and constant or variable frequency.

The inherent series resonance frequency of the first impedance (Z101) and the second impedance (Z102) in series connection is the same as the pulse period of the pulsed power from the power source to appear series resonance status, thereby the pulsed power input is converted to the bi-directional divided power in series resonance.

A rectifier device (BR101): At least one rectifier device (BR101) is installed to receive the divided power across the two ends of the first impedance (Z101) or the second impedance (Z102), or two or more than two rectifier devices (BR101) are respectively installed to receive the divided power across the two ends of the first impedance (Z101) and the second impedance (Z102) thereby the bi-directional divided power in series resonance across the two ends of the first impedance (Z101) or the second impedance (Z102) is rectified to DC power to drive the uni-directional conducting light emitting diode set (L100).

The rectifier device can be constituted by a bridge type rectifier device or by a half-wave rectifier device, whereof the number of rectifier device (BR101) can be one or more than one.

An uni-directional conducting light emitting diode set (L100): The uni-directional conducting light emitting diode set (L100) is constituted by a forward current polarity light emitting diode (LED101), or two or more than two forward current polarity light emitting diodes (LED101) in series connection or parallel connection, or three or more than three forward current polarity light emitting diodes (LED101) in series connection, parallel connection, or series and parallel connection.

One or more than one uni-directional conducting light emitting diode set (L100) can be optionally installed as needed;

The uni-directional light emitting diode drive circuit (U100) is constituted by the first impedance (Z101), the second impedance (Z102), the rectifier device (BR101) and the unidirectional conducting light emitting diode set (L100) according to above said circuit structure.

The operating functions of the unidirectional light emitting diode drive circuit (U100) in the above said unidirectional light emitting diode drive circuit in pulsed power series resonance further include the following:

An unidirectional light emitting diode drive circuit (U100), in which uni-directional conducting light emitting diode set (L100) is through the divided power distribution effect by the parallel connection between the rectifier device (BR101) and the second impedance (Z102) to reduce the voltage variation rate across the two ends of unidirectional conducting light emitting diode set (L100) corresponding to the power source of voltage variation.

The divided power formed across the two ends of the inductive impedance component (I200) of second impedance (Z102) in series resonance is provided to the AC input ends of the rectifier device (BR101), whereof the DC power output of the rectifier device (BR101) is used to drive the unidirectional conducting light emitting diode set (L100) while its output current is limited by the capacitive impedance of the capacitor (C100) which constitutes the first impedance (Z101).

The divided power formed across the two ends of the capacitor (C100) of the first impedance (Z101) in series resonance is provided to the AC input ends of the rectifier device (BR101), whereof the DC power output of the rectifier device (BR101) is used to drive the unidirectional conducting light emitting diode set (L100) while its output current is limited by the inductive impedance of the inductive impedance component (I200) which constitutes the second impedance (Z102).

The circuit function operations of the unidirectional light emitting diode drive circuit (U100) of the unidirectional light emitting diode drive circuit in pulsed power series resonance in actual applications are as shown in FIGS. 1, 2, in which the following auxiliary circuit components can be optionally selected as needed to be installed or not installed while the quantity of the installation can be constituted by one or by more than one, whereof in case of more than one components are selected, they can be selected based on circuit function requirements to be in series connection, or parallel connection, or series and parallel connection in corresponding polarities, whereof the optionally selected auxiliary circuit components include the following:

A discharge resistor (R101): It is an optional component to be parallel connected across the two ends of the capacitor (C100) which constitutes the first impedance (Z101) to release the residual charge of the capacitor (C100); the discharge resistor (R101) can be optionally installed as needed to be constituted by one or by more than one in series connection or parallel connection or series and parallel connection.

A current limit resistor (R103): It is an optional component to be individually series connected with each of light emitting diodes (LED101) which constitute the uni-directional conducting light emitting diode set (L100), whereby to limit the current passing through the light emitting diode (LED101); whereof the current limit resistor (R103) can also be replaced by an inductive impedance component (I103); the current limit resistor (R103) can be optionally installed as needed to be constituted by one or by more than one in series connection or parallel connection or series and parallel connection, while the inductive impedance component (I103) can be constituted by one or by more than one in series connection or parallel connection or series and parallel connection which is optionally installed as needed.

In addition, to protect the light emitting diode and to avoid the light emitting diode (LED101) being damaged or reduced working life by abnormal voltage, in the unidirectional light emitting diode drive circuit in pulsed power series resonance, whereof the uni-directional light emitting diode drive circuit (U100) can be further parallel connected a zener diode across the two ends of the light emitting diode (LED101) of the unidirectional conducting light emitting diode set (L100), or the zener diode can be first series connected with at least one diode to produce the function of zener voltage effect, then parallel connected across the two ends of the light emitting diode (LED101).

Figure 3:
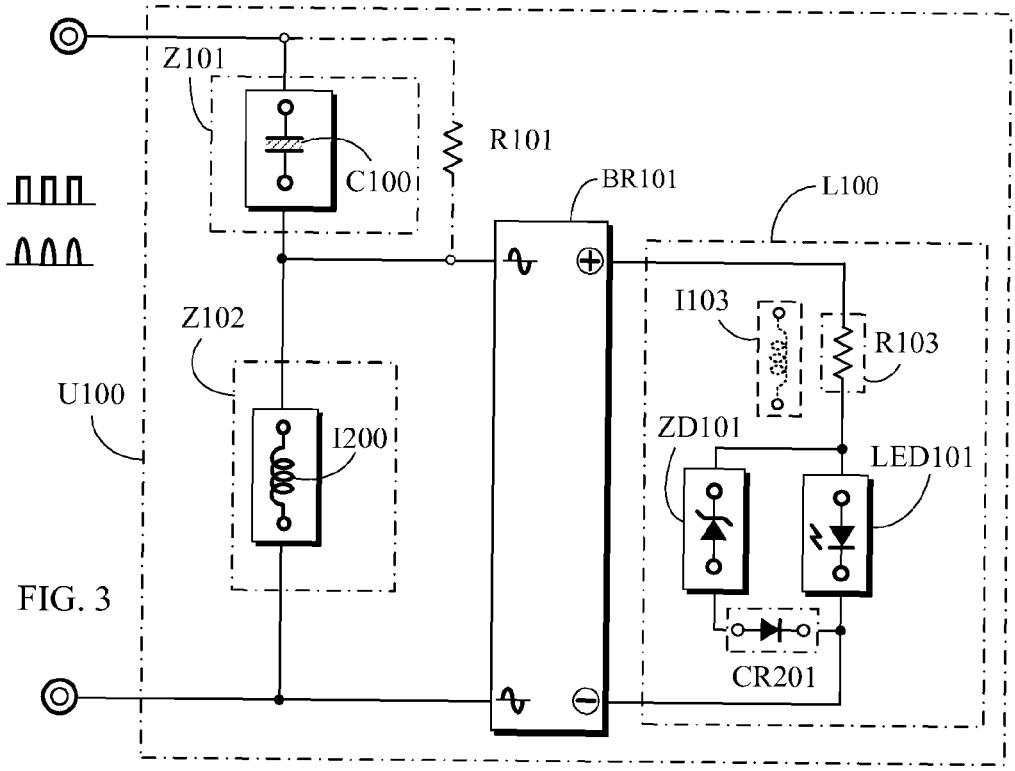
FIG. 3 is a circuit example schematic diagram illustrating that the uni-directional conducting light emitting diode set in the circuit of FIG. 2 is further installed with a zener diode.

FIG. 3 is a circuit example schematic diagram illustrating that the unidirectional conducting light emitting diode set in the circuit of FIG. 2 is further installed with a zener diode, whereof it is constituted by the following:

A zener diode (ZD101) is parallel connected across the two ends of the light emitting diode (LED101) of the unidirectional conducting light emitting diode set (L100) in the unidirectional light emitting diode drive circuit (U100), whereof their polarity relationship is that the zener voltage of the zener diode (ZD101) is used to limit the working voltage across the two ends of the light emitting diode (LED101); whereof the zener diode (ZD101) can be constituted by one or by more than one in series connection or parallel connection or series and parallel connection which is optionally installed as needed;

A zener diode (ZD101) is parallel connected across the two ends of the light emitting diode (LED101) of the unidirectional conducting light emitting diode set (L100) in the unidirectional light emitting diode drive circuit (U100), whereof the said zener diode (ZD101) can be optionally series connected with a diode (CR201) as needed to produce the zener voltage effect together, and the diode (CR201) can be constituted by one or by more than one in series connection or parallel connection or series and parallel connection which is optionally installed as needed, whereby the advantages of the diode (CR201) to be optionally installed are 1) the zener diode (ZD101) can be protected from abnormal reverse voltage; 2) both diode (CR201) and zener diode (ZD101) have temperature compensation effect.

To promote the lighting stability of the light source produced by the light emitting diode in the uni-directional light emitting diode drive circuit (U100) of the uni-directional light emitting diode drive circuit in pulsed power series resonance, the light emitting diode (LED101) can be further installed with a charge/discharge device (ESD101), whereof random power charging or discharging can be provided by the charge/discharge device (ESD101) to stabilize the lighting stability of the light emitting diode (LED101), whereby to reduce its lighting pulsation, or in case of power supply off, reserved power can be supplied by the charge/discharge device (ESD101) to drive the light emitting diode (LED101) to emit light continuously.

Figure 4:
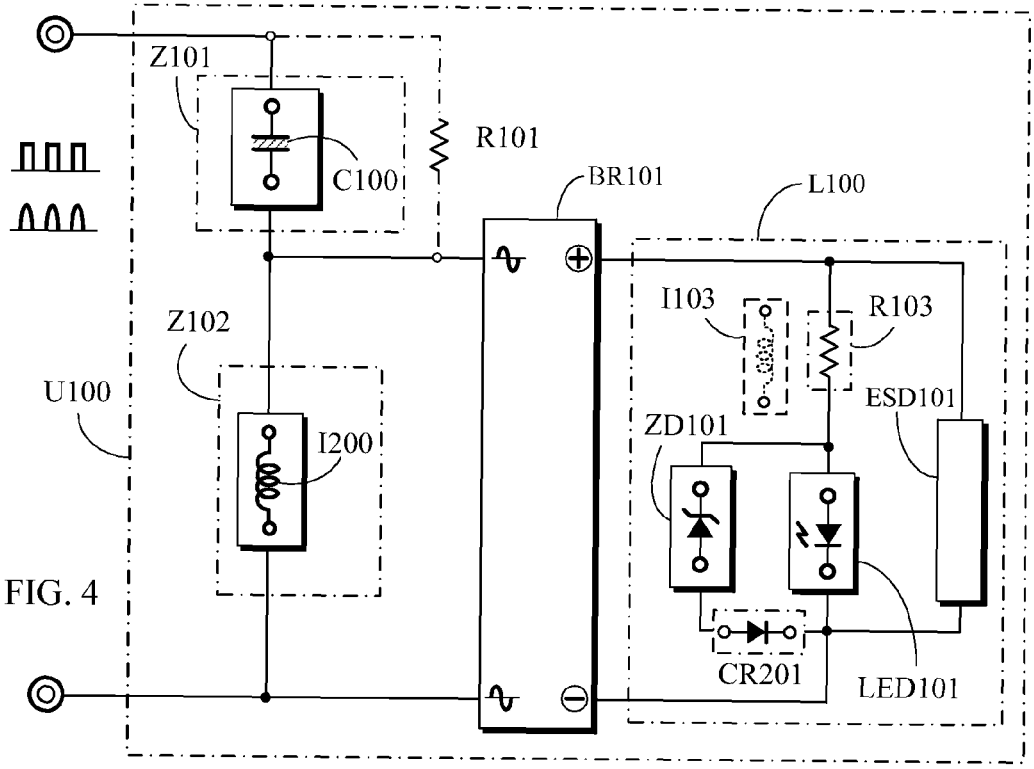
FIG. 4 is a circuit example schematic diagram illustrating that a charge/discharge device is parallel connected across the two ends of the light emitting diode and the current limit resistor in series connection in the circuit of FIG. 3.

As shown in FIG. 4, which is a circuit example schematic diagram illustrating that a charge/discharge device is parallel connected across the two ends of the light emitting diode and the current limit resistor in series connection in the circuit of FIG. 3.

Figure 5:
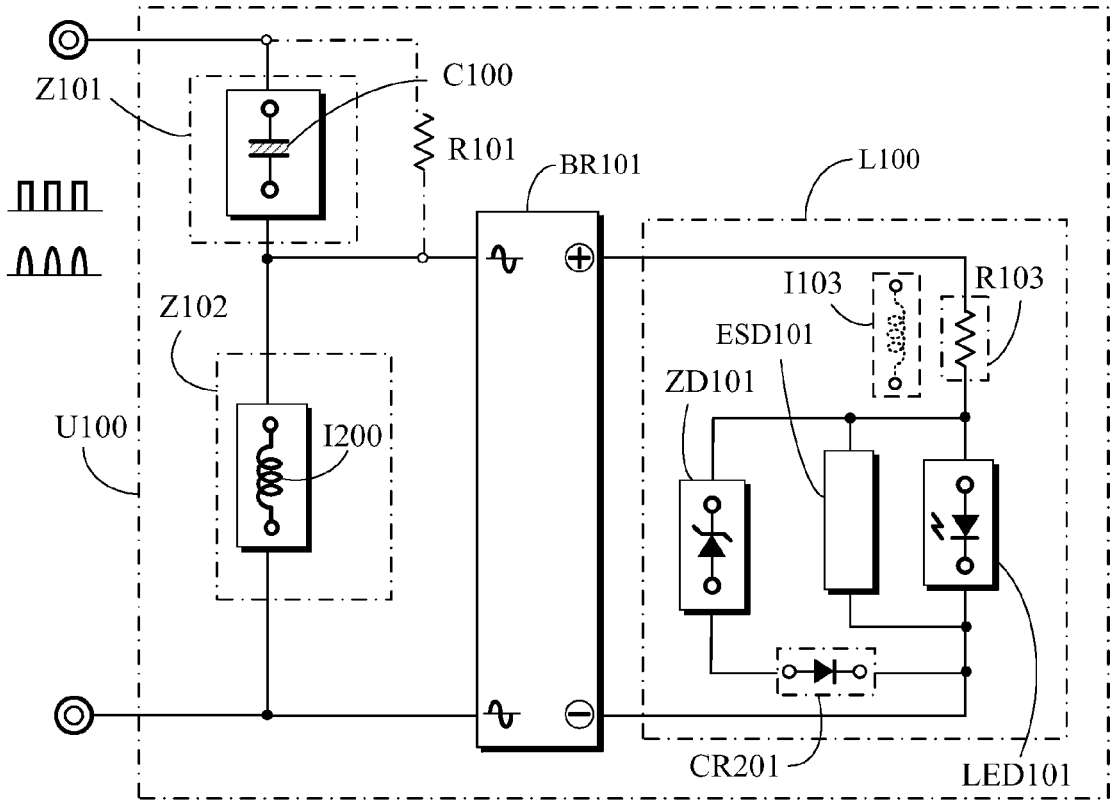
FIG. 5 is a circuit example schematic diagram illustrating that a charge/discharge device is parallel connected across the two ends of the light emitting diode in the circuit of FIG. 3.

As shown in FIG. 5, which is a circuit example schematic diagram illustrating that a charge/discharge device is parallel connected across the two ends of the light emitting diode in the circuit of FIG. 3.

FIG. 4 and FIG. 5 are comprised of that:

The uni-directional conducting light emitting diode set (L100) can be further installed with a charge/discharge device (ESD101) including to be parallel connected across the two ends of the light emitting diode (LED101) and the current limit resistor (R103) or the inductive impedance component (I103) in series connection as shown in FIG. 4, or across the two ends of the light emitting diode (LED101) as shown in FIG. 5 according to polarities, whereof random power charging or discharging can be provided by the charge/discharge device (ESD101) to stabilize the lighting stability of the light emitting diode (LED101), whereby to reduce its lighting pulsation, or in case of power supply off, reserved power can be supplied by the charge/discharge device (ESD101) to drive the light emitting diode (LED101) to emit light continuously.

The aforementioned charge/discharge device (ESD101) can be constituted by the conventional charging and discharging batteries, or super-capacitors or capacitors, etc.

The charge/discharge device (ESD101) can be constituted by one or by more than one in series connection or parallel connection or series and parallel connection, whereof said device can be optionally installed as needed.

The first impedance (Z101), the second impedance (Z102), the rectifier device (BR101) and the unidirectional conducting light emitting diode set (L100) as well as the light emitting diode (LED101) and various aforesaid optional auxiliary circuit components as shown in the circuit examples of FIGS. 1-5 are based on application needs, whereof they can be optionally installed or not installed as needed and the installation quantity include constitution by one, wherein if more than one components are selected in the application, the corresponding polarity relationship shall be determined based on circuit function requirement to do series connection, or parallel connection, or series and parallel connections; thereof it is constituted as the following:

1. The first impedance (Z101) can be constituted by a capacitor (C100) or by more than one capacitors (C100) in series connection, parallel connection, or series and parallel connection;

2. The second impedance (Z102) can be constituted by an inductive impedance component (I200) or by more than one inductive impedance components (I200) in series connection, parallel connection, or series and parallel connection;

3. The light emitting diode (LED101) can be constituted by one or by more than one light emitting diode in series connection of forward polarities, or in parallel connection of the same polarity, or in series and parallel connection;

4. In the uni-directional conducting light emitting diode set (L100):

(1) An uni-directional light emitting diode or more than one uni-directional conducting light emitting diode sets (L100) in series connection, parallel connection, or series and parallel connection can be optionally installed as needed in the uni-directional light emitting diode drive circuit (U100), whereof if one or more than one set is installed, it can be driven by the divided power of a common impedance (Z102) through its matched rectifier device (BR101), or it can be individually driven by the divided power of multiple sets of second impedances (Z102) in series or parallel connection, whereof each of the multiple sets of second impedances (Z102) is installed with a rectifier device (BR101) individually to drive its corresponding matched uni-directional conducting light emitting diode set (L100) individually;

(2) If a charge/discharge device (ESD101) is installed in the uni-directional light emitting diode drive circuit (U100), then the light emitting diode (LED101) of the uni-directional conducting light emitting diode set (L100) is driven by DC power to emit light continuously;

If the charge/discharge device (ESD101) is not installed, then current conduction to light emitting diode (LED101) is intermittent, whereby referring to the input voltage wave shape and duty cycle of current conduction, the light emitting forward current and the peak of light emitting forward voltage of each light emitting diode in the uni-directional conducting light emitting diode set (L100) can be correspondingly selected for the light emitting diode (LED101), whereof the selections include the following:

1) The light emitting peak of forward voltage is lower than the rated forward voltage of light emitting diode (LED101); or 2) The rated forward voltage of light emitting diode (LED101) is selected to be the light emitting peak of forward voltage; or 3) If current conduction to light emitting diode (LED101) is intermittent, the peak of light emitting forward voltage can be correspondingly selected based on the duty cycle of current conduction as long as the principle of that the peak of light emitting forward voltage does not damage the light emitting diode (LED101) is followed;

4) Based on the value and wave shape of the aforesaid light emitting forward voltage, the corresponding current value and wave shape from the forward voltage vs. forward current ratio are produced; however the peak of light emitting forward current shall follow the principle not to damage the light emitting diode (LED101);

5) The luminosity or the stepped or step-less luminosity modulation of the forward current vs. relative luminosity can be selected as needed to be either conducted by fixed voltage to emit light or controlled based on the value and wave shape of forward current;

In the application of the uni-directional light emitting diode drive circuit (U100) of the uni-directional light emitting diode drive circuit in pulsed power series resonance, the following different types of pulsed power can be provided for inputs, whereof the pulsed power includes that:

(1) DC pulsed power; or (2) The DC pulsed power with constant or variable voltage and constant or variable periods converted from DC power source; or (3) The DC pulsed power with constant or variable voltage and constant or variable periods converted from DC power which is further rectified from AC power; or (4) The half-wave or full-wave DC pulsed power rectified from AC power with constant or variable voltage and constant or variable frequency.

Figure 6:
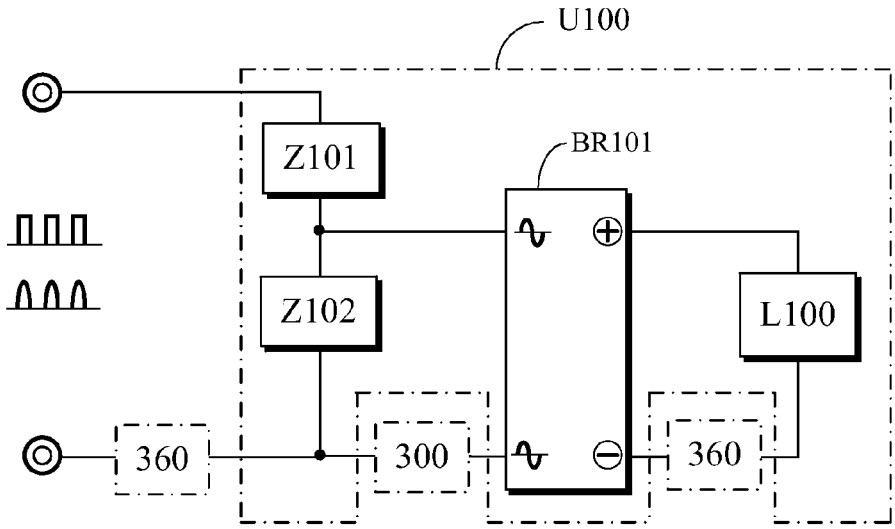
FIG. 6 is a circuit example schematic block diagram of the present invention which is series connected to a power modulator of series connection type.

The following active modulating circuit devices can be further optionally combined as needed, whereof the applied circuits are the following:

1. FIG. 6 is a circuit example schematic block diagram of the present invention which is series connected to the power modulator of series connection type, whereof the power modulator of series connection is constituted by the following:

A bi-directional power modulator of series connection type (300): It is constituted by the conventional electromechanical components or solid state power components and related electronic circuit components to modulate the bi-directional power output; or A DC power modulator of series connection type (360): It is constituted by the conventional electromechanical components or solid state power components and related electronic circuit components to modulate the DC power for voltage stabilization, or DC pulsed power output.

Figure 7:
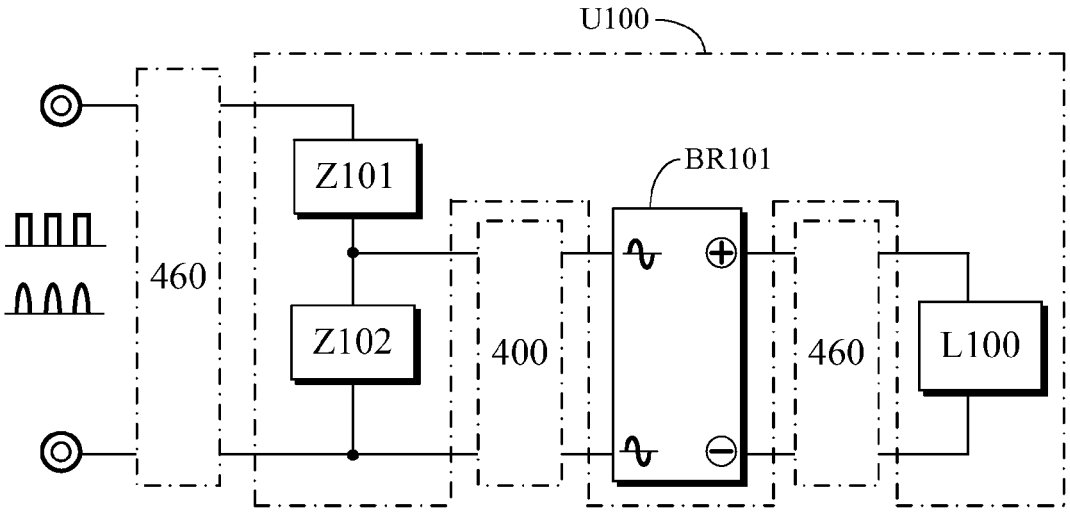
FIG. 7 is a circuit example schematic block diagram of the present invention which is parallel connected to a power modulator of parallel connection type.

The circuit operating functions are the following:

(1) The DC power modulator of series connection type (360) can be optionally installed as needed to be series connected with the uni-directional light emitting diode drive circuit (U100) to receive the pulsed power from power source, whereby the pulsed power is modulated by the DC power modulator of series connection type (360) to execute power modulations such as pulse width modulation or current conduction phase angle control, or impedance modulation, etc. to drive the uni-directional conducting light emitting diode set (L100); or (2) The bi-directional power modulator of series connection type (300) can be optionally installed as needed to be series connected between the second impedance (Z102) and the AC input ends of the rectifier device (BR101) whereby the bi-directional divided power in series resonance across the two ends of the second impedance (Z102) is modulated by the bi-directional power modulator of series connection type (300) to execute power modulations such as pulse width modulation or current conduction phase angle control, or impedance modulation, etc. to drive the uni-directional conducting light emitting diode set (L100) through the rectifier device (BR101); or (3) The DC power modulator of series connection type (360) can be optionally installed as needed to be series connected between the DC output ends of the rectifier device (BR101) and the unidirectional light emitting diode drive circuit (U100), whereby DC power from the rectifier device (BR101) is modulated by the DC power modulator of series connection type (360) to execute power modulations such as pulse width modulation or current conduction phase angle control, or impedance modulation, etc. to drive the unidirectional conducting light emitting diode set (L100);

2. FIG. 7 is a circuit example schematic block diagram of the present invention which is parallel connected to a power modulator of parallel connection type, whereof the power modulator of parallel connection type is constituted by the following:

A bi-directional power modulator of parallel connection type (400): It is constituted by the conventional electromechanical components or solid state power components and related electronic circuit components to modulate the bi-directional power output; or A DC power modulator of parallel connection type (460): It is constituted by the conventional electromechanical components or solid state power components and related electronic circuit components to modulate the DC power for voltage stabilization, or DC pulsed power output.

Figure 8:
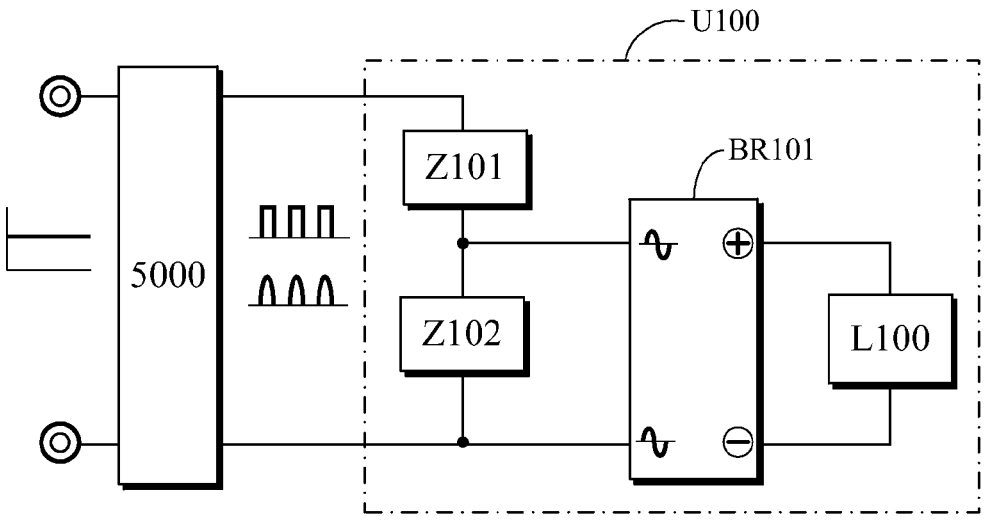
FIG. 8 is a circuit example schematic block diagram of the present invention to be driven by the DC to DC converter output power.

The circuit operating functions are the following:

(1) The DC power modulator of parallel connection type (460) can be optionally installed as needed, whereof its output ends are for parallel connection with the unidirectional light emitting diode drive circuit (U100), while its input ends are provided for receiving the pulsed power from the power source, whereby the pulsed power is modulated by the DC power modulator of parallel connection type (460) to execute power modulations such as pulse width modulation or current conduction phase angle control, or impedance modulation, etc. to drive the uni-directional light emitting diode drive circuit (U100); or (2) The bi-directional power modulator of parallel connection type (400) can be optionally installed as needed, whereof its output ends are parallel connected with the bi-directional power input ends of the rectifier device (BR101) while its input ends are parallel connected across the two ends of the second impedance (Z102), whereby the bi-directional divided power in bi-directional series resonance across the two ends of the second impedance (Z102) is modulated by the bi-directional power modulator of parallel connection type (400) to execute power modulations such as pulse width modulation or current conduction phase angle control, or impedance modulation, etc. to drive the uni-directional conducting light emitting diode set (L100) by the DC power rectified by the rectifier device (BR101); or (3) The DC power modulator of parallel connection type (460) can be optionally installed as needed, whereof its output ends are parallel connected with the uni-directional conducting light emitting diode set (L100), while its input ends are parallel connected with the DC output ends of the rectifier device (BR101), whereby the DC power from the rectifier device (BR101) is modulated by the DC power modulator of parallel connection type (460) to execute power modulations such as pulse width modulation or current conduction phase angle control, or impedance modulation, etc. to drive the uni-directional conducting light emitting diode set (L100);

3. FIG. 8 is a circuit example schematic block diagram of the present invention to be driven by the power outputted from a DC to DC converter;

It is mainly comprised of that:

A DC to DC converter (5000): It is constituted by conventional electromechanical components or solid state power components and related electronic circuit components, whereof its input ends receive DC power input while its output ends optionally provide for outputting the DC pulsed power with a constant or variable voltage and constant or variable periods as needed;

The circuit operating functions are the following:

A DC to DC converter (5000), in which its input ends receive DC power while its output ends provide DC pulsed power, wherein the uni-directional light emitting diode drive circuit (U100) is parallel connected with the output ends of the DC to DC converter (5000), and the input ends of the DC to DC converter receive the optionally selected DC power of constant or variable voltage, or the DC power rectified from AC power;

The output provided by the output ends of the DC to DC converter (5000) can be optionally selected as needed to be a pulsed power with constant or variable voltage and constant or variable periods to control and drive the uni-directional light emitting diode drive circuit (U100);

In addition, the output power of the DC to DC converter (5000) can be optionally operated as needed to control the uni-directional light emitting diode drive circuit (U100) in series resonance, or to modulate its power output for pulse width modulation or current conduction phase angle control, or impedance modulation, etc. to control and drive the uni-directional light emitting diode drive circuit (U100);

4. The uni-directional light emitting diode drive circuit (U100) is arranged to be series connected with a least one conventional impedance component (500) and further to be parallel connected with the power source, whereof the impedance (500) includes that:

(1) An impedance component (500): it is constituted by a component with capacitive impedance characteristics; or (2) An impedance component (500): it is constituted by a component with inductive impedance characteristics; or (3) An impedance component (500): it is constituted by a component with resistive impedance characteristics; or (4) An impedance component (500): it is constituted by a single impedance component with the combined impedance characteristics of at least two of the resistive impedance, or inductive impedance, or capacitive impedance simultaneously, thereby to provide DC or AC impedances; or (5) An impedance component (500): it is constituted by a single impedance component with the combined impedance characteristics of the inductive impedance or capacitive impedance, whereof its combined resonance frequency is the same as the frequency of bi-directional power or the pulse period of uni-directional pulsed power, thereby to produce a parallel resonance status; or (6) An impedance component (500): it is constituted by capacitive impedance components, or inductive impedance components, or resistive impedance components, including one or more than one kind of one and more than one impedance component, or two or more than two kinds of impedance components in series connection, or parallel connection, or series and parallel connections, thereby to provide a DC or AC impedance;

(7) An impedance component (500): it is constituted by the mutual series connection of a capacitive impedance component and an inductive impedance component, whereof its combined inherent series resonance frequency is the same as the frequency of the bi-directional power or the pulse period of the uni-directional pulsed power, thereby to produce a series resonance status and the end voltage across two ends of the capacitive impedance component or the inductive impedance component appear in series resonance correspondingly;

or the capacitive impedance and the inductive impedance are mutually parallel connected, whereby its combined inherent parallel resonance frequency is the same as the frequency of bi-directional power or the pulse period of the unidirectional pulsed power, thereby to produce a parallel resonance status and appear the corresponding end voltage.

Figure 9:
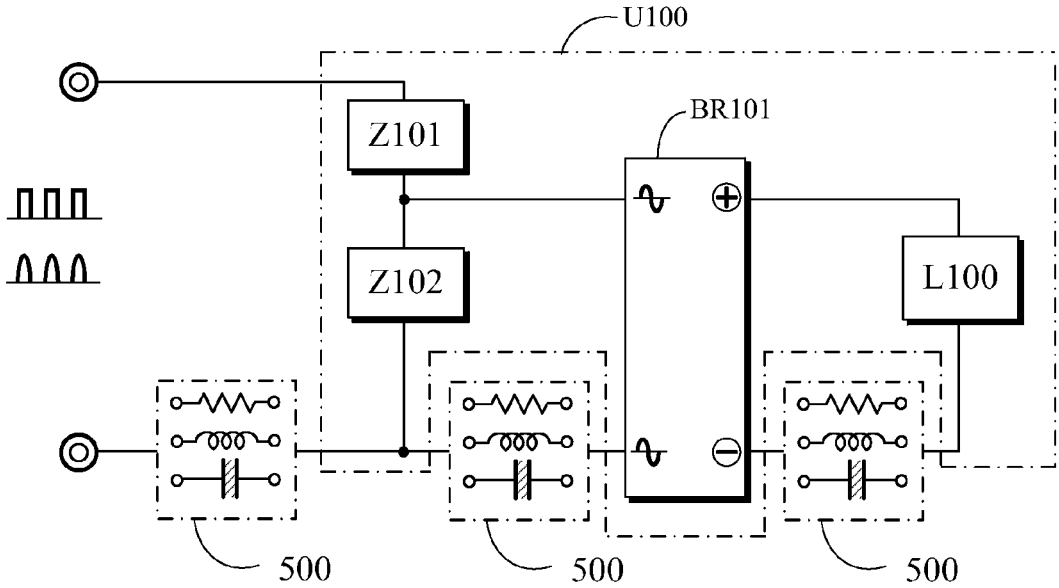
FIG. 9 is a circuit example schematic block diagram of the present invention which is series connected with impedance components.
Figure 10:
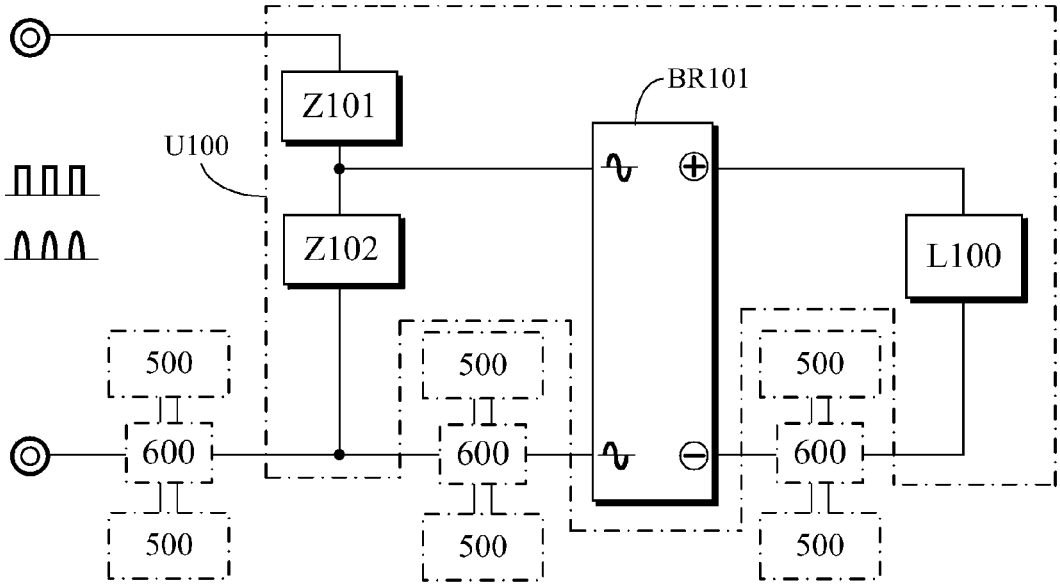
FIG. 10 is a circuit example schematic block diagram of the present invention illustrating that the impedance components in series connection execute series connection, or parallel connection, or series and parallel connection by means of the switching device.

FIG. 9 is a circuit example schematic block diagram of the present invention to be series connected with impedance components;

5. At least two impedance components (500) as said in the item 4 execute switches between series connection, parallel connection and series and parallel connection by means of combining with the switching device (600) which is constituted by electromechanical components or solid state components, whereby to modulate the power transmitted to the uni-directional light emitting diode drive circuit (U100), wherein FIG. 10 is a circuit example schematic block diagram of the present invention illustrating that the impedance components in series connection execute series connection, or parallel connection, or series and parallel connection by means of the switching device.

The uni-directional light emitting diode drive circuit in pulsed power series resonance of the present invention, in which the optionally installed inductive impedance component (I200) of second impedance (Z102) can be further replaced by the power supply side winding of a transformer with inductive effect, whereof the transformer can be a self-coupled transformer (ST200) with self-coupled voltage change winding or a transformer (IT200) with separating type voltage change winding.

Figure 11:
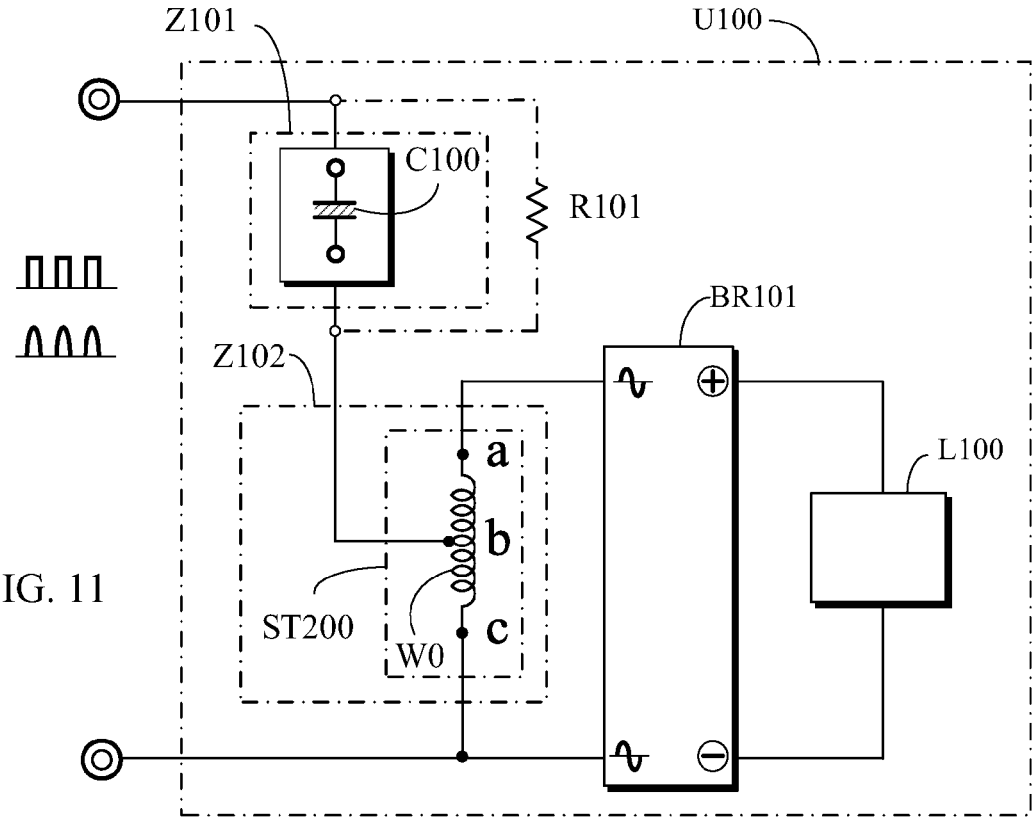
FIG. 11 is a circuit example schematic diagram of the present invention illustrating that the inductive impedance component of the second impedance is replaced by the self-coupled voltage change power supply side winding of the self-coupled transformer thereby to constitute a voltage rise.

FIG. 11 is a circuit example schematic diagram of the present invention illustrating that the inductive impedance component of the second impedance is replaced by the self-coupled voltage change power supply side winding of the self-coupled transformer thereby to constitute a voltage rise, whereof as shown in FIG. 11, the self-coupled transformer (ST200) has a self-coupled voltage change winding (W0) with voltage raising function, the b, c ends of the self-coupled voltage change winding (W0) of the self-coupled transformer (ST200) are the power supply side which replace the inductive impedance component (I200) of the second impedance (Z102) to constitute the second impedance (Z102), whereof its inherent series resonance frequency with the capacitor (C100) of the first impedance (Z101) in series connection is the same as the pulse period of the pulsed power from the power source to appear series resonance status, whereof the a, c output ends of the self-coupled voltage change winding (W0) of the self-coupled transformer (ST200) are arranged to output AC power of voltage rise for transmitting to the AC input ends of the rectifier device (BR101), while the DC output ends of the rectifier device (BR101) are used to drive the uni-directional conducting light emitting diode set (L100).

Figure 12:
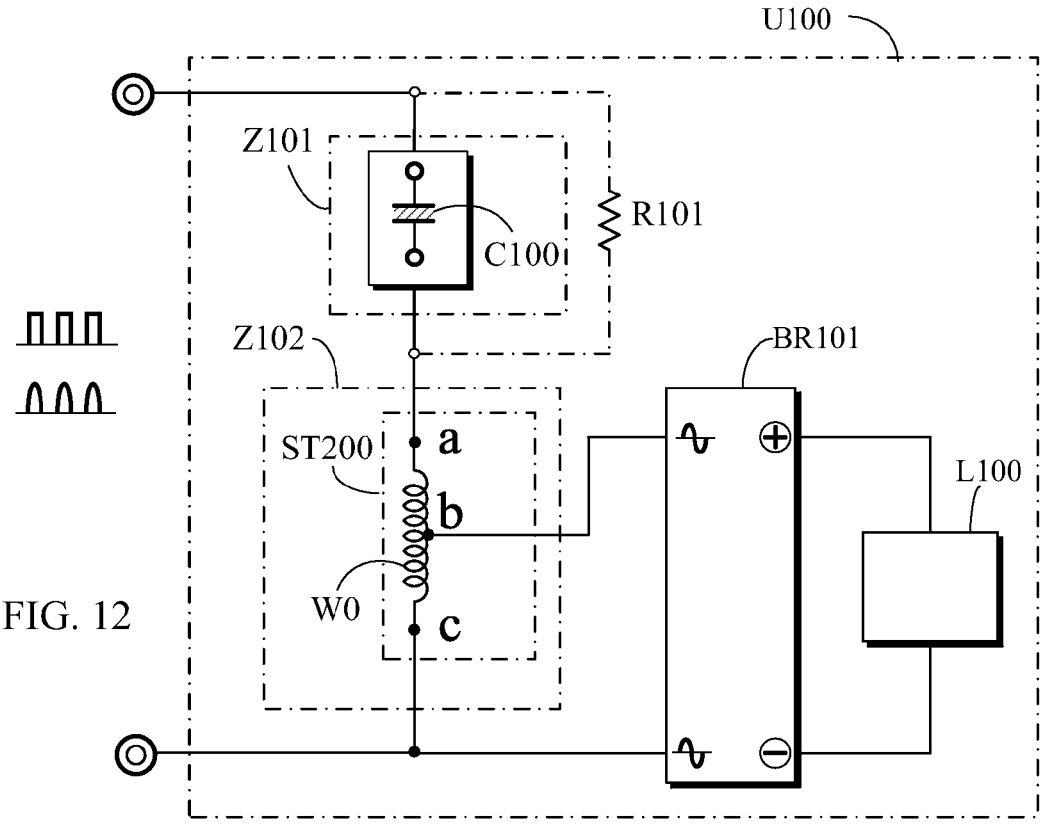
FIG. 12 is a circuit example schematic diagram of the present invention illustrating that the inductive impedance component of the second impedance is replaced by the self-coupled voltage change power supply side winding of the self-coupled transformer thereby to constitute a voltage drop.

FIG. 12 is a circuit example schematic diagram of the present invention illustrating that the inductive impedance component of the second impedance is replaced by the self-coupled voltage change power supply side winding of the self-coupled transformer thereby to constitute a voltage drop, whereof as shown in FIG. 12, the self-coupled transformer (ST200) has a self-coupled voltage change winding (W0) with voltage drop function, in which the a, c ends of the self-coupled voltage change winding (W0) of the self-coupled transformer (ST200) are the power supply side which replace the inductive impedance component (I200) of the second impedance (Z102) to constitute the second impedance (Z102), whereof its inherent series resonance frequency with the capacitor (C100) of the first impedance (Z101) in series connection is the same as the pulse period of the pulsed power from the power source to appear series resonance status, whereof the b, c output taps of the self-coupled voltage change winding (W0) of the self-coupled transformer (ST200) is arranged to output AC power of voltage drop for transmitting to the AC input ends of the rectifier device (BR101) while the DC output ends of the rectifier device (BR101) is used to drive the uni-directional conducting light emitting diode set (L100).

Figure 13:
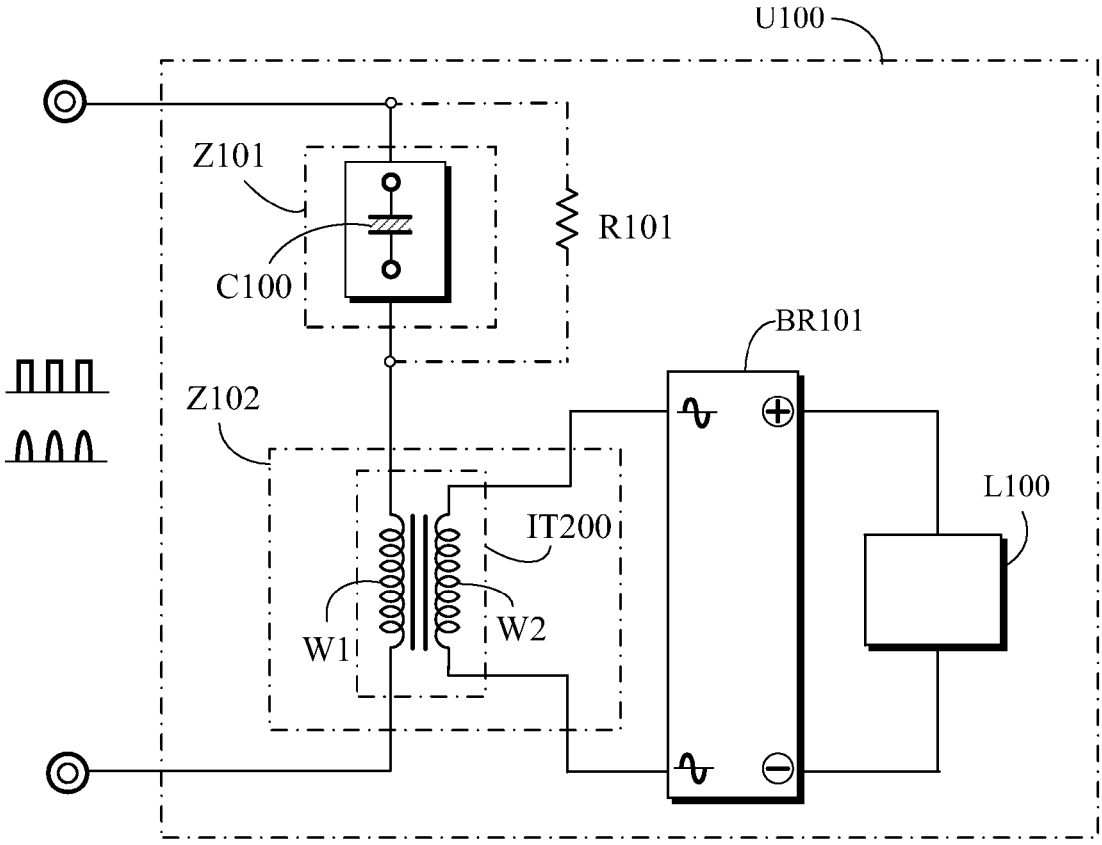
FIG. 13 is a circuit example schematic diagram of the present invention illustrating that the inductive impedance component of the second impedance is replaced by the primary side winding of the separating type transformer with separating type voltage change winding.

FIG. 13 is a circuit example schematic diagram of the present invention illustrating that the inductive impedance component of the second impedance is replaced by the primary side winding of the separating type transformer with separating type voltage change winding. As shown in FIG. 13, the separating type transformer (IT200) is comprised of a primary side winding (W1) and a secondary side winding (W2), in which the primary side winding (W1) and the secondary side winding (W2) are separated, whereof the primary side winding (W1) constitutes the second impedance (Z102), whereof its inherent series resonance frequency in series connection with the capacitor (C100) of the first impedance (Z101) is the same as the pulse period of the pulsed power from the power source to appear series resonance status, whereof the output voltage of the secondary side winding (W2) of the separating type transformer (IT200) can be optionally selected as needed to provide AC power of voltage rise or voltage drop, whereof the AC power outputted from the secondary side winding (W2) is arranged to transmit to the AC input ends of the rectifier device (BR101) while the DC output ends of the rectifier device (BR101) is used to transmit the DC power to the uni-directional conducting light emitting diode set (L100).

From the above description, the inductive impedance component (I200) of the second impedance (Z102) is replaced by the power supply side winding of the transformer, whereof the secondary side of the separating type transformer (IT200) provides AC power of voltage rise or voltage drop to the AC input ends of the rectifier device (BR101) while the DC output ends of the rectifier device (BR101) are used to drive the uni-directional conducting light emitting diode set (L100).

Color of the individual light emitting diodes (LED101) of the uni-directional conducting light emitting diode set (L100) in the uni-directional light emitting diode drive circuit (U100) of the uni-directional light emitting diode drive circuit in pulsed power series resonance of the present invention can be optionally selected to be constituted by one or by more than one colors.

The relationships of location arrangement between the individual light emitting diodes (LED101) of the uni-directional conducting light emitting diode set (L100) in the uni-directional light emitting diode drive circuit (U100) of the uni-directional light emitting diode drive circuit in pulsed power series resonance of the present invention include the following: 1) sequentially linear arrangement 2) sequentially distributed in a plane 3) crisscross-linear arrangement 4) crisscross distribution in a plane 5) arrangement based on particular geometric positions in a plane 6) arrangement based on 3D geometric position.

The uni-directional light emitting diode drive circuit in pulsed power series resonance, in which the embodiments of its unidirectional light emitting diode drive circuit (U100) are constituted by circuit components which include: 1) It is constituted by individual circuit components which are inter-connected; 2) At least two circuit components are combined to at least two partial functioning units which are further inter-connected; 3) All components are integrated to one structure.

As is summarized from above descriptions, progressive performances of power saving, low heat loss and low cost can be provided by the uni-directional light emitting diode drive circuit in pulsed power series resonance through the charging/discharging by the uni-polar capacitor to drive the light emitting diode.

The invention claimed is:

1. A uni-directional light emitting diode drive circuit in pulsed power series resonance, wherein capacitive or inductive impedance components in series connection are provided with a pulsed power input, wherein divided power in series resonance across the two ends of the capacitive impedance component or of the inductive impedance component is rectified by a rectifier device to the DC power output, thereby to drive the uni-directional conducting light emitting diode set to emit light; wherein the uni-directional light emitting diode drive circuit in pulsed power series resonance, in which the circuit function and operation of the uni-directional light emitting diode drive circuit (U100) is mainly comprised of a first impedance which includes at least one capacitive impedance component and a second impedance which includes at least one inductive component, wherein the inherent series resonance frequency of the first impedance and second impedance in series connection is the same as the pulse period of the pulsed power from the power source to appear series resonance status;

the two ends of the first impedance and the second impedance in series connection are provided for inputting:

1) DC pulsed power; or

2) DC pulsed power with constant or variable voltage and constant or variable periods converted from DC power source; or 3) DC pulsed power with constant or variable voltage and constant or variable periods converted from DC power which is further rectified from AC power; or 4) half-wave or full-wave DC pulsed power rectified from AC power with constant or variable voltage and constant or variable frequency;

in addition, it is installed with at least one rectifier device, wherein its AC input ends are provided to receive a bi-directional divided power input in series connection across the two ends of at least one impedance of the first impedance (Z101) or the second impedance (Z102), or is installed with at least two rectifier devices, wherein their AC input ends are respectively provided to receive the bi-directional divided power input in series resonance across the two ends of the first impedance or of the second impedance;

the uni-directional conducting light emitting diode set which includes at least one light emitting diodes is driven by the DC power output across the positive and negative ends of a rectifier device;

the bi-directional divided power in series resonance of the first and second impedances is rectified by the rectifier device to drive at least one uni-directional conducting light emitting diode or is rectified by the two or more than two rectifier devices which are respectively parallel connected across the two ends of the first and second impedances to provide DC power output to drive the individual uni-directional conducting light emitting diode;

wherein:

the first impedance (Z101) includes at least one capacitive impedance component, or two or more than two capacitive impedance components in series connection, or parallel connection, or series and parallel connection, or the first impedance (Z101) includes at least one capacitive impedance component, and is configured to be installed with one or more than one, and one kind or more than one kind of additional inductive impedance components or resistive impedance components, or with two or more than two kinds of impedance components, wherein each kind of impedance component includes one or more than one impedance component in series connection or parallel connection or series and parallel connection; and the second impedance (Z102) includes an inductive impedance component or two or more than two inductive impedance components in series connection, or parallel connection, or series and parallel connection, or the second impedance (Z102) includes an inductive impedance component, and one or more than one, or one kind or more than one kind of additional capacitive impedance components or resistive impedance components, or two or more than two kinds of impedance components, wherein each kind of impedance component includes one or by more than one impedance component in series connection, or parallel connection, or series and parallel connection; and the first impedance (Z101) and the second impedance (Z102) are mutually series connected, wherein the two ends of the first impedance (Z101) and the second impedance (Z102) in series connection are provided for inputting:

the DC pulsed power; or the DC pulsed power with constant or variable voltage and constant or variable periods converted from DC power source; or the DC pulsed power with constant or variable voltage and constant or variable periods converted from DC power which is further rectified from AC power; or the half-wave or full-wave DC pulsed power rectified from AC power with constant or variable voltage and constant or variable frequency;

the inherent series resonance of the first impedance component (Z101) and second impedance (Z102) in series connection is the same as the pulse period of the pulsed power source so as to appear series resonance status, wherein the divided power in series resonance is converted from the pulsed power input to the first impedance (Z101) and the second impedance (Z102) and provided to the AC input ends of the rectifier device (BR101);

the rectifier device (BR101) is parallel connected across the two ends of the first impedance (Z101) or of the second impedance (Z102), or respectively parallel connected across two ends of the first impedance (Z101) and of the second impedance (Z102) simultaneously, thereby the bi-directional divided power across the two ends of the first impedance (Z101) or the second impedance (Z102) is rectified to DC power to drive the uni-directional conducting light emitting diode set (L100);

the rectifier device can include a bridge type rectifier device or by a half-wave rectifier device, wherein the number of rectifier device (BR101) can be one or more than one;

the uni-directional conducting light emitting diode set (L100) includes a forward current polarity light emitting diode, or two or more than two forward current polarity light emitting diodes in series connection or parallel connection, or three or more than three forward current polarity light emitting diodes in series connection, or parallel connection, or series and parallel connection;

the uni-directional conducting light emitting diode set (L100) can be disposed with one or more than one set as needed for driven by DC power outputted from the rectifier device (BR101);

one or more than one first impedance (Z101), second impedance (Z102), uni-directional conducting light emitting diode set (L100) and rectifier device (BR101) in the uni-directional light emitting diode drive circuit (U100) can be installed as needed;

the bi-directional divided power produced by the first impedance or second impedance in series resonance is rectified by a rectifier device to DC power and is used to drive at least one uni-directional conducting light emitting diode, or the AC powers of the first impedance and of the second impedance are respectively rectified by the two rectifier devices which are respectively parallel connected across the two ends of the first impedance and second impedance to DC powers and are used to drive the individual uni-directional conducting light emitting diodes, thereby to constitute the uni-directional light emitting diode drive circuit in pulsed power series resonance;

said first impedance (Z101), second impedance (Z102), rectifier device (BR101) and uni-directional conducting light emitting diode set (L100) as well as said light emitting diode (LED101) and various optional auxiliary circuit components are based on application needs, wherein they can be installed or not installed as needed and the installation quantity include constitution by one, wherein if more than one components are selected in the application, the corresponding polarity relationship shall be determined based on circuit function requirement to do series connection, or parallel connection, or series and parallel connections.

2. The uni-directional light emitting diode drive circuit in pulsed power series resonance as claimed in claim 1, wherein:

the first impedance (Z101) including at least one capacitive impedance component, especially capacitor (C100), wherein the number of the first impedance can be one or more than one;

the second impedance (Z102) including at least one inductive impedance component (I200), wherein the number of the second impedance can be one or more than one;

the first impedance (Z101) and the second impedance are in series connection, wherein the two ends of them after series connection are provided for inputting:

the DC pulsed power; or the DC pulsed power with constant or variable voltage and constant or variable periods converted from DC power source; or the DC pulsed power with constant or variable voltage and constant or variable periods converted from DC power which is further rectified from AC power; or the half-wave or full-wave DC pulsed power rectified from AC power with constant or variable voltage and constant or variable frequency;

the inherent series resonance frequency of the first impedance (Z101) and the second impedance (Z102) in series connection is the same as the pulse period of the pulsed power from the power source to appear series resonance status, thereby the pulsed power input is converted to the bi-directional divided power in series resonance;

the rectifier device (BR101): is installed to receive the divided power across the two ends of the first impedance (Z101) or the second impedance (Z102), or two or more than two rectifier devices (BR101) are respectively installed to receive the divided power across the two ends of the first impedance (Z101) and the second impedance (Z102) thereby the bi-directional divided power in series resonance across the two ends of the first impedance (Z101) or the second impedance (Z102) is rectified to DC power to drive the uni-directional conducting light emitting diode set (L100);

the rectifier device can include a bridge type rectifier device or by a half-wave rectifier device, wherein the number of rectifier device (BR101) can be one or more than one;

the uni-directional conducting light emitting diode set (L100) includes a forward current polarity light emitting diode (LED101), or two or more than two forward current polarity light emitting diodes (LED101) in series connection or parallel connection, or three or more than three forward current polarity light emitting diodes (LED101) in series connection, parallel connection, or series and parallel connection;

one or more than one uni-directional conducting light emitting diode set (L100) can be installed as needed;

the uni-directional light emitting diode drive circuit (U100) comprises the first impedance (Z101), the second impedance (Z102), the rectifier device (BR101) and the uni-directional conducting light emitting diode set (L100) according to above said circuit structure;

the operating functions of the uni-directional light emitting diode drive circuit (U100) in the above said uni-directional light emitting diode drive circuit in pulsed power series resonance further include the following:

the uni-directional light emitting diode drive circuit (U100), in which uni-directional conducting light emitting diode set (L100) is through the divided power distribution effect by the parallel connection between the rectifier device (BR101) and the second impedance (Z102) to reduce the voltage variation rate across the two ends of uni-directional conducting light emitting diode set (L100) corresponding to the power source of voltage variation;

the divided power formed across the two ends of the inductive impedance component (I200) of second impedance (Z102) in series resonance is provided to the AC input ends of the rectifier device (BR101), wherein the DC power output of the rectifier device (BR101) is used to drive the uni-directional conducting light emitting diode set (L100) while its output current is limited by the capacitive impedance of the capacitor (C100) which constitutes the first impedance (Z101);

the divided power formed across the two ends of the capacitor (C100) of the first impedance (Z101) in series resonance is provided to the AC input ends of the rectifier device (BR101), wherein the DC power output of the rectifier device (BR101) is used to drive the uni-directional conducting light emitting diode set (L100) while its output current is limited by the inductive impedance of the inductive impedance component (I200) which constitutes the second impedance (Z102).

3. The uni-directional light emitting diode drive circuit in pulsed power series resonance as claimed in claim 1, wherein the following auxiliary circuit components can be optionally selected as needed to be installed or not installed while the quantity of the installation can include one or by more than one, wherein in case of more than one components are selected, they can be selected based on circuit function requirements to be in series connection, or parallel connection, or series and parallel connection in corresponding polarities, wherein the selected auxiliary circuit components include the following:

a discharge resistor (R101) to be parallel connected across the two ends of the capacitor (C100) which constitutes the first impedance (Z101) to release the residual charge of the capacitor (C100); the discharge resistor (R101) can be installed as needed to include one or by more than one in series connection or parallel connection or series and parallel connection;

a current limit resistor (R103) to be individually series connected with each of light emitting diodes (LED101) which constitute the uni-directional conducting light emitting diode set (L100), whereby to limit the current passing through the light emitting diode (LED101); wherein the current limit resistor (R103) can also be replaced by an inductive impedance component (I103); the current limit resistor (R103) can be optionally installed as needed to include one or by more than one in series connection or parallel connection or series and parallel connection, while the inductive impedance component (I103) can include one or by more than one in series connection or parallel connection or series and parallel connection which is optionally installed as needed.

4. The uni-directional light emitting diode drive circuit in pulsed power series resonance as claimed in claim 1, wherein a zener diode can be parallel connected across the two ends of the light emitting diode (LED101) of the uni-directional conducting light emitting diode set (L100), or the zener diode can be first series connected with at least one diode to produce the function of zener voltage effect, then parallel connected across the two ends of the light emitting diode (LED101); wherein:

a zener diode (ZD101) is parallel connected across the two ends of the light emitting diode (LED101) of the uni-directional conducting light emitting diode set (L100) in the uni-directional light emitting diode drive circuit (U100), wherein their polarity relationship is that the zener voltage of the zener diode (ZD101) is used to limit the working voltage across the two ends of the light emitting diode (LED101); wherein the zener diode (ZD101) can include one or by more than one in series connection or parallel connection or series and parallel connection which is optionally installed as needed.

5. The uni-directional light emitting diode drive circuit in pulsed power series resonance as claimed in claim 1, wherein the zener diode (ZD101) is parallel connected across the two ends of the light emitting diode (LED101) of the uni-directional conducting light emitting diode set (L100), wherein said zener diode (ZD101) can be series connected with a diode (CR201) as needed to produce the zener voltage effect together, and the diode (CR201) can include one or by more than one in series connection or parallel connection or series and parallel connection which is optionally installed as needed, whereby the advantages of the diode (CR201) to be optionally installed are 1) the zener diode (ZD101) can be protected from abnormal reverse voltage; 2) both diode (CR201) and zener diode (ZD101) have temperature compensation effect.

6. The uni-directional light emitting diode drive circuit in pulsed power series resonance as claimed in claim 1, wherein the light emitting diode (LED101) is installed with a charge/discharge device (ESD101), wherein random power charging or discharging can be provided by the charge/discharge device (ESD101) to stabilize the lighting stability of the light emitting diode (LED101), whereby to reduce its lighting pulsation, or in case of power supply off, reserved power can be supplied by the charge/discharge device (ESD101) to drive the light emitting diode (LED101) to emit light continuously, wherein:

the uni-directional conducting light emitting diode set (L100) can be further installed with a charge/discharge device (ESD101) including to be parallel connected across the two ends of the light emitting diode (LED101) and the current limit resistor (R103) or the inductive impedance component (I103) in series connection, or across the two ends of the light emitting diode (LED101) according to polarities, wherein random power charging or discharging can be provided by the charge/discharge device (ESD101) to stabilize the lighting stability of the light emitting diode (LED101), whereby to reduce its lighting pulsation, or in case of power supply off, reserved power can be supplied by the charge/discharge device (ESD101) to drive the light emitting diode (LED101) to emit light continuously;

the aforementioned charge/discharge device (ESD101) can include conventional charging and discharging batteries, or super-capacitors or capacitors;

the charge/discharge device (ESD101) can include one or by more than one in series connection or parallel connection or series and parallel connection, wherein said device can be installed as needed.

7. The uni-directional light emitting diode drive circuit in pulsed power series resonance as claimed in claim 1, wherein for the uni-directional conducting light emitting diode set (L100), an uni-directional light emitting diode or more than one uni-directional conducting light emitting diode sets (L100) in series connection, parallel connection, or series and parallel connection can be optionally installed as needed in the uni-directional light emitting diode drive circuit (U100), wherein if one or more than one set is installed, it can be driven by the divided power of a common impedance (Z102) through its matched rectifier device (BR101), or it can be individually driven by the divided power of multiple sets of second impedances (Z102) in series or parallel connection, wherein each of the multiple sets of second impedances (Z102) is installed with a rectifier device (BR101) individually to drive its corresponding matched uni-directional conducting light emitting diode set (L100) individually.

8. The uni-directional light emitting diode drive circuit in pulsed power series resonance as claimed in claim 1, wherein if a charge/discharge device (ESD101) is installed in the uni-directional light emitting diode drive circuit (U100), then the light emitting diode (LED101) of the uni-directional conducting light emitting diode set (L100) is driven by DC power to emit light continuously.

9. The uni-directional light emitting diode drive circuit in pulsed power series resonance as claimed in claim 1, wherein if the charge/discharge device (ESD101) is not installed, then current conduction to light emitting diode (LED101) is intermittent, whereby referring to the input voltage wave shape and duty cycle of current conduction, the light emitting forward current and the peak of light emitting forward voltage of each light emitting diode in the uni-directional conducting light emitting diode set (L100) can be correspondingly selected for the light emitting diode (LED101), wherein if current conduction to light emitting diode (LED101) is intermittent, the peak of light emitting forward voltage can be correspondingly selected based on the duty cycle of current conduction as long as the principle of that the peak of light emitting forward voltage does not damage the light emitting diode (LED101) is followed.

10. The uni-directional light emitting diode drive circuit in pulsed power series resonance as claimed in claim 1, wherein if the charge/discharge device (ESD101) is not installed, then based on the value and wave shape of the aforesaid light emitting forward voltage, the corresponding current value and wave shape from the forward voltage vs. forward current ratio are produced; however the peak of light emitting forward current shall follow the principle not to damage the light emitting diode (LED101).

11. The uni-directional light emitting diode drive circuit in pulsed power series resonance as claimed in claim 1, wherein in the application of the uni-directional light emitting diode drive circuit (U100), the following different types of pulsed power can be provided for inputs, wherein the pulsed power includes:

i. the DC pulsed power; or ii. the DC pulsed power with constant or variable voltage and constant or variable periods converted from DC power source; or iii. the DC pulsed power with constant or variable voltage and constant or variable periods converted from DC power which is further rectified from AC power; or iv. the half-wave or full-wave DC pulsed power rectified from AC power with constant or variable voltage and constant or variable frequency.

12. The uni-directional light emitting diode drive circuit in pulsed power series resonance as claimed in claim 1, wherein it is series connected to the power modulator of series connection type, wherein the power modulator of series connection includes the following:

a bi-directional power modulator of series connection type (300) including conventional electromechanical components or solid state power components and related electronic circuit components to modulate the bi-directional power output; or a DC power modulator of series connection type (360) including conventional electromechanical components or solid state power components and related electronic circuit components to modulate the DC power for voltage stabilization, or DC pulsed power output;

the circuit operating functions are the following:

the DC power modulator of series connection type (360) is series connected with the uni-directional light emitting diode drive circuit (U100) to receive the pulsed power from power source, whereby the pulsed power is modulated by the DC power modulator of series connection type (360) to execute power modulations such as pulse width modulation or current conduction phase angle control, or impedance modulation to drive the uni-directional conducting light emitting diode set (L100); or the bi-directional power modulator of series connection type (300) is series connected between the second impedance (Z102) and the AC input ends of the rectifier device (BR101) whereby the bi-directional divided power in series resonance across the two ends of the second impedance (Z102) is modulated by the bi-directional power modulator of series connection type (300) to execute power modulations such as pulse width modulation or current conduction phase angle control, or impedance modulation to drive the uni-directional conducting light emitting diode set (L100) through the rectifier device (BR101); or the DC power modulator of series connection type (360) is series connected between the DC output ends of the rectifier device (BR101) and the uni-directional light emitting diode drive circuit (U100), whereby DC power from the rectifier device (BR101) is modulated by the DC power modulator of series connection type (360) to execute power modulations such as pulse width modulation or current conduction phase angle control, or impedance modulation to drive the uni-directional conducting light emitting diode set (L100).

13. The uni-directional light emitting diode drive circuit in pulsed power series resonance as claimed in claim 1, wherein it is parallel connected to a power modulator of parallel connection type, wherein the power modulator of parallel connection type includes the following:

a bi-directional power modulator of parallel connection type (400) including conventional electromechanical components or solid state power components and related electronic circuit components to modulate the bi-directional power output; or a DC power modulator of parallel connection type (460) including conventional electromechanical components or solid state power components and related electronic circuit components to modulate the DC power for voltage stabilization, or DC pulsed power output;

the circuit operating functions are the following:

v. for the DC power modulator of parallel connection type (460), its output ends are for parallel connection with the uni-directional light emitting diode drive circuit (U100), while its input ends are provided for receiving the pulsed power from the power source, whereby the pulsed power is modulated by the DC power modulator of parallel connection type (460) to execute power modulations such as pulse width modulation or current conduction phase angle control, or impedance modulation to drive the uni-directional light emitting diode drive circuit (U100); or vi. for the bi-directional power modulator of parallel connection type (400), its output ends are parallel connected with the bi-directional power input ends of the rectifier device (BR101) while its input ends are parallel connected across the two ends of the second impedance (Z102), whereby the bi-directional divided power in bi-directional series resonance across the two ends of the second impedance (Z102) is modulated by the bi-directional power modulator of parallel connection type (400) to execute power modulations such as pulse width modulation or current conduction phase angle control, or impedance modulation to drive the uni-directional conducting light emitting diode set (L100) by the DC power rectified by the rectifier device (BR101); or vii. for the DC power modulator of parallel connection type (460), its output ends are parallel connected with the uni-directional conducting light emitting diode set (L100), while its input ends are parallel connected with the DC output ends of the rectifier device (BR101), whereby the DC power from the rectifier device (BR101) is modulated by the DC power modulator of parallel connection type (460) to execute power modulations such as pulse width modulation or current conduction phase angle control, or impedance modulation to drive the uni-directional conducting light emitting diode set (L100).

14. The uni-directional light emitting diode drive circuit in pulsed power series resonance as claimed in claim 1, wherein it is driven by the power outputted from a DC to DC converter, wherein:

a DC to DC converter (5000) including conventional electromechanical components or solid state power components and related electronic circuit components, wherein its input ends receive DC power input while its output ends optionally provide for outputting the DC pulsed power with a constant or variable voltage and constant or variable periods as needed;

the circuit operating functions are the following:

a DC to DC converter (5000), in which its input ends receive DC power while its output ends provide DC pulsed power, wherein the uni-directional light emitting diode drive circuit (U100) is parallel connected with the output ends of the DC to DC converter (5000), and the input ends of the DC to DC converter receive the optionally selected DC power of constant or variable voltage, or the DC power rectified from AC power;

the output provided by the output ends of the DC to DC converter (5000) can be optionally selected as needed to be a pulsed power with constant or variable voltage and constant or variable periods to control and drive the uni-directional light emitting diode drive circuit (U100);

in addition, the output power of the DC to DC converter (5000) can be optionally operated as needed to control the uni-directional light emitting diode drive circuit (U100) in series resonance, or to modulate its power output for pulse width modulation or current conduction phase angle control, or impedance modulation to control and drive the uni-directional light emitting diode drive circuit (U100).

15. The uni-directional light emitting diode drive circuit in pulsed power series resonance as claimed in claim 1, wherein the uni-directional light emitting diode drive circuit (U100) is series connected with a least one conventional impedance component (500) and further to be parallel connected with the power source, wherein the impedance (500) includes:

viii. a component with capacitive impedance characteristics; or ix. a component with inductive impedance characteristics; or x. a component with resistive impedance characteristics; or xi. a single impedance component with the combined impedance characteristics of at least two of the resistive impedance, or inductive impedance, or capacitive impedance simultaneously, thereby to provide DC or AC impedances; or xii. a single impedance component with the combined impedance characteristics of the inductive impedance or capacitive impedance, wherein its combined resonance frequency is the same as the frequency of bi-directional power or the pulse period of uni-directional pulsed power, thereby to produce a parallel resonance status; or xiii. capacitive impedance components, or inductive impedance components, or resistive impedance components, including one or more than one kind of one and more than one impedance component, or two or more than two kinds of impedance components in series connection, or parallel connection, or series and parallel connections, thereby to provide a DC or AC impedance; or xiv. the mutual series connection of a capacitive impedance component and an inductive impedance component, wherein its combined inherent series resonance frequency is the same as the frequency of the bi-directional power or the pulse period of the uni-directional pulsed power, thereby to produce a series resonance status and the end voltage across two ends of the capacitive impedance component or the inductive impedance component appear in series resonance correspondingly;

or the capacitive impedance and the inductive impedance are mutually parallel connected, whereby its combined inherent parallel resonance frequency is the same as the frequency of bi-directional power or the pulse period of the uni-directional pulsed power, thereby to produce a parallel resonance status and appear the corresponding end voltage.

16. The uni-directional light emitting diode drive circuit in pulsed power series resonance as claimed in claim 1, wherein the optionally installed inductive impedance component (I200) of second impedance (Z102) can be further replaced by the power supply side winding of a transformer with inductive effect, in which the self-coupled transformer (ST200) has a self-coupled voltage change winding (W0) with voltage raising function, the b, c ends of the self-coupled voltage change winding (W0) of the self-coupled transformer (ST200) are the power supply side which replace the inductive impedance component (I200) of the second impedance (Z102) to constitute the second impedance (Z102), wherein its inherent series resonance frequency with the capacitor (C100) of the first impedance (Z101) in series connection is the same as the pulse period of the pulsed power from the power source to appear series resonance status, wherein the a, c output ends of the self-coupled voltage change winding (W0) of the self-coupled transformer (ST200) are arranged to output AC power of voltage rise for transmitting to the AC input ends of the rectifier device (BR101), while the DC output ends of the rectifier device (BR101) are used to drive the uni-directional conducting light emitting diode set (L100).

17. The uni-directional light emitting diode drive circuit in pulsed power series resonance as claimed in claim 1, wherein the optionally installed inductive impedance component (I200) of second impedance (Z102) can be further replaced by the power supply side winding of a transformer with inductive effect, in which the self-coupled transformer (ST200) has a self-coupled voltage change winding (W0) with voltage drop function, in which the a, c ends of the self-coupled voltage change winding (W0) of the self-coupled transformer (ST200) are the power supply side which replace the inductive impedance component (I200) of the second impedance (Z102) to constitute the second impedance (Z102), wherein its inherent series resonance frequency with the capacitor (C100) of the first impedance (Z101) in series connection is the same as the pulse period of the pulsed power from the power source to appear series resonance status, wherein the b, c output taps of the self-coupled voltage change winding (W0) of the self-coupled transformer (ST200) is arranged to output AC power of voltage drop for transmitting to the AC input ends of the rectifier device (BR101) while the DC output ends of the rectifier device (BR101) is used to drive the uni-directional conducting light emitting diode set (L100).

18. The uni-directional light emitting diode drive circuit in pulsed power series resonance as claimed in claim 1, wherein the optionally installed inductive impedance component (I200) of second impedance (Z102) can be further replaced by the power supply side winding of a transformer with inductive effect, in which the separating type transformer (IT200) is comprised of a primary side winding (W1) and a secondary side winding (W2), in which the primary side winding (W1) and the secondary side winding (W2) are separated, wherein the primary side winding (W1) constitutes the second impedance (Z102), wherein its inherent series resonance frequency in series connection with the capacitor (C100) of the first impedance (Z101) is the same as the pulse period of the pulsed power from the power source to appear series resonance status, wherein the output voltage of the secondary side winding (W2) of the separating type transformer (IT200) can be optionally selected as needed to provide AC power of voltage rise or voltage drop, wherein the AC power outputted from the secondary side winding (W2) is arranged to transmit to the AC input ends of the rectifier device (BR101) while the DC output ends of the rectifier device (BR101) is used to transmit the DC power to the uni-directional conducting light emitting diode set (L100);

the inductive impedance component (I200) of the second impedance (Z102) is replaced by the power supply side winding of the transformer, wherein the secondary side of the separating type transformer (IT200) provides AC power of voltage rise or voltage drop to the AC input ends of the rectifier device (BR101) while the DC output ends of the rectifier device (BR101) are used to drive the uni-directional conducting light emitting diode set (L100).

* * * * *